US007092649B2

(12) United States Patent
Hirota et al.

(10) Patent No.: US 7,092,649 B2
(45) Date of Patent: Aug. 15, 2006

(54) CHARGING DEVICE AND IMAGE FORMING APPARATUS PROVIDED THEREWITH

(75) Inventors: Akira Hirota, Okazaki (JP); Kentaro Katori, Toyokawa (JP); Masahiko Matsuura, Suita (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 196 days.

(21) Appl. No.: 10/923,872

(22) Filed: Aug. 24, 2004

(65) Prior Publication Data

US 2005/0220470 A1 Oct. 6, 2005

(30) Foreign Application Priority Data

Mar. 31, 2004 (JP) ..... 2004-104001
Mar. 31, 2004 (JP) ..... 2004-104015
Mar. 31, 2004 (JP) ..... 2004-104034

(51) Int. Cl.
*G03G 15/02* (2006.01)

(52) U.S. Cl. ..... 399/50; 399/115; 399/150

(58) Field of Classification Search ..... 399/38, 399/50, 107, 110, 115, 130, 148, 149, 150
See application file for complete search history.

(56) References Cited

U.S. PATENT DOCUMENTS 5,479,244 A * 12/1995 Kashihara et al. ..... 399/175
5,678,142 A 10/1997 Saegusa
6,240,269 B1 * 5/2001 Kaya et al. ..... 399/128
6,596,452 B1 * 7/2003 Magome et al. ..... 430/106.2
6,922,539 B1 * 7/2005 Uyama et al. ..... 399/129
2005/0063728 A1 * 3/2005 Harada et al. ..... 399/100

FOREIGN PATENT DOCUMENTS

| | | |
|---|---|---|
| JP | 63-149668 | 6/1988 |
| JP | 8-190269 | 7/1996 |
| JP | 2001-188405 | 7/2001 |

* cited by examiner

*Primary Examiner*—Hoan Tran
(74) *Attorney, Agent, or Firm*—Morrison & Foerster LLP

(57) ABSTRACT

An image forming apparatus has a charging member opposed to an outer circumferential surface of a rotating object to be charged. The image forming apparatus has a voltage applying section for applying a pulsating voltage Vsp between the charging member and the object to be charged. The pulsating voltage Vsp is obtained by superimposing a voltage component of a direct current on a voltage component that periodically changes. The image forming apparatus is made to satisfy a relation of $Vpp \leqq |Vth|$, where Vpp is a peak-to-peak voltage value of the pulsating voltage Vsp and Vth is a charging start voltage value of the object to be charged. The relation prevents opposite charge from being imparted to residual toner on the object to be charged.

21 Claims, 11 Drawing Sheets

CHARGING DEVICE AND IMAGE FORMING APPARATUS PROVIDED THEREWITH

CROSS-REFERENCE TO RELATED APPLICATIONS

This application is based on applications No. 2004-104001, No. 2004-104015 and No. 2004-104034 filed in Japan, the entire contents of which are hereby incorporated by reference.

BACKGROUND OF THE INVENTION

The present invention relates to a charging device and an image forming apparatus provided with the device. In particular, the present invention relates to a charging device suitable for charging an electrostatic latent image carrier that serves as an object to be charged and an image forming apparatus provided with the device. As the image forming apparatus, there are typically enumerated copiers, printers, facsimiles and composite apparatuses of these apparatuses.

As the charging device of this kind of image forming apparatus, there has conventionally been widely known a device of a system in which a charging member such as a roller, a pad, and a sheet is brought in contact or proximity with a photoreceptor drum (the device being hereinafter referred to as a "contact charging device").

As described in a first patent document JP 63-149668A for example, a pulsating voltage (Vdc+Vac) obtained by superimposing a dc voltage Vdc on an ac voltage Vac is generally applied between the charging member and the photoreceptor drum, and the peak-to-peak voltage value (Vpp) of the pulsating voltage is set two or more times the charging start voltage value (Vth) of the photoreceptor drum in order to obtain uniform charge. That is, the peak-to-peak voltage value (Vpp) is set at $Vpp \geqq 2Vth$.

However, this setting has a problem that the toner disadvantageously adheres to the charging member and causes defective charging because opposite charge is imparted (injected) from the charging member to the toner, which remains on the surface of the photoreceptor drum in the transfer process, when the residual toner passes along the charging member. Moreover, according to a system in which a developing device (hereinafter referred to as a "contact developing device") brought in contact with the photoreceptor drum and the aforementioned charging device are provided to carry out development while collecting the residual toner by the contact developing device (the so-called cleanerless system), there is a problem that, when the opposite charge is imparted to the residual toner on the photoreceptor drum, the collection of toner by the contact developing device becomes insufficient, generating a defective image.

As a measure against the toner adhesion to the charging member, there has conventionally been known the technique of "mechanically" removing the residual toner on the surface of the charging member by bringing a pad-shaped cleaning member in contact with the charging member. Moreover, as described in a second patent document JP 2001-188405A, there has been known the technique of "electrically" transferring the residual toner on the charging member onto the photoreceptor drum by switching the polarity of the discharge electric field formed between the object to be charged and the charging member.

However, the aforementioned "mechanical" technique has the problem of causing the complication and cost increase (including the number of assembling processes) of the apparatus due to the addition of the cleaning member. Moreover, the aforementioned "electrical" technique has the problem of needing complicated troublesome voltage control for switching the discharge electric field and so on, causing the complication and cost increase of the apparatus.

For example, a third patent document JP 8-190269A proposes the technique of improving the toner collection performance of a contact developing device by providing a charge control member (coloring powder contact charging member) on the upstream side (between the transfer means and the charging means) of charging means around the photoreceptor drum and applying a bias voltage that is not lower than the charging start voltage to this charge control member for the achievement of uniform electric charge (polarity) of the toner that remains on the photoreceptor drum without transferring the toner by transfer means.

However, there is a possibility that opposite charge is imparted (injected) from the charge control member to the toner that remains on the surface of the photoreceptor drum in the transfer process by the aforementioned technique. Since the electric charge (polarity) of the toner becomes nonuniform when the opposite charge is imparted to the residual toner on the photoreceptor drum, there is a problem that toner collection by the contact developing device (development process) becomes insufficient, generating a defective image. There is a further problem that the toner disadvantageously adheres to the charging member when the opposite charge is imparted to the residual toner on the photoreceptor drum, causing defective charging.

SUMMARY OF THE INVENTION

An object of the present invention is to provide a charging device capable of uniformly charging the object to be charged and preventing opposite charge from being imparted to the residual toner on the object to be charged.

Another object of this invention is to provide an image forming apparatus provided with such the charging device.

In order to achieve the aforementioned objects, a first aspect of the present invention provides a charging device comprising:

a charging member opposed to an outer circumferential surface of a rotating object to be charged; and a voltage applying section for applying a pulsating voltage obtained by superimposing a voltage component of a direct current on a voltage component that periodically changes between the charging member and the object to be charged, wherein a relation of $$Vpp \leqq |Vth|$$

is satisfied, where

Vpp is a peak-to-peak voltage value of the pulsating voltage, and

Vth is a charging start voltage value of the object to be charged.

In this case, the charging member "opposed to" the outer circumferential surface of the object to be charged includes a charging member brought in contact or in proximity with the surface of the object to be charged.

When image formation is carried out by an electrophotographic system using the charging device according to this invention, the relation of $Vpp \leqq |Vth|$ prevents an opposite charge from being imparted to i.e. injected into residual toner on the object to be charged, specifically, an electrostatic latent image carrier at the time of passing through the charging member. This stabilizes the charge property of the residual toner. As a result, toner adhesion to the charging member is prevented, which eliminates the possibility of causing defective charging. Therefore, the image quality is maintained satisfactory for a long term. Moreover, a contact developing device reliably collects toner even when a cleaner device is omitted in combination of the contact developing device and the charging device.

Furthermore, there is no need to provide any mechanical or electrical cleaning means intended for cleaning the charging member. Moreover, this charging device regulates the peak-to-peak voltage value Vpp of the pulsating voltage, and therefore, the complicated control of switching the discharge electric field or the like is not required. Thus, this charging device is constructed simple at low cost.

A second aspect of the present invention provides a charging device comprising:

a charging member opposed to an outer circumferential surface of a rotating object to be charged; and a voltage applying section for applying a pulsating voltage obtained by superimposing a voltage component of a direct current on a voltage component that periodically changes between the charging member and the object to be charged, wherein a relation of $$|V\text{max}-Vo|>|Vth|>|V\text{min}-Vo|$$

is satisfied, where

Vth is a charging start voltage value of the object to be charged,

Vo is each voltage of the charged object surface located both upstream and downstream of the charging member in relation to a movement direction of the outer circumferential surface of the object to be charged, Vmax is a maximum value of the pulsating voltage, and Vmin is a minimum value of the pulsating voltage.

When image formation is carried out by an electrophotographic system using the charging device according to this invention, the relation of |Vmax−Vo|>|Vth|>|Vmin−Vo| prevents an opposite charge from being imparted to i.e. injected into residual toner on the object to be charged such as an electrostatic latent image carrier at the time of passing through the charging member. Specifically, the relation of |Vmax−Vo|>|Vth| allows regular charging to be carried out to the object to be charged during applying a bias by the charging member. On the other hand, the relation of |Vth|>|Vmin−Vo| allows reverse charging not to be carried out to the object to be charged. Thus, the opposite charge is prevented from being imparted to the residual toner on the electrostatic latent image carrier at the time of passing through the charging member. As a result, toner adhesion to the charging member is prevented, which eliminates the possibility of causing defective charging and therefore, the image quality is maintained satisfactory for a long term. In addition, the same effects and advantages are obtained as in the case with the first aspect of the invention.

Furthermore, there is no need to provide cleaning means (mechanical or electrical technique) intended for cleaning the charging member. Moreover, this charging device, which regulates the maximum value (Vmax) and the minimum value (Vmin) of the pulsating voltage, therefore does not require the complicated control of switching the discharge electric field or the like. Therefore, this charging device is constructed simple at low cost.

A third aspect of the present invention provides a charging device comprising:

a charging member opposed to an outer circumferential surface of a rotating object to be charged; and a charge control member opposed to the object to be charged in a position located upstream of the charging member in relation to a movement direction of the outer circumferential surface of the object to be charged; and a voltage applying section for applying voltages for controlling a surface voltage of the object to be charged, between the charge control member and the object to be charged and between the charging member and the object to be charged, respectively, wherein the voltages are applied so that a relation of $$|Vo(i)|<|Vo(ii)|<|Vo(iii)|$$

is satisfied, where

Vo(i) is a voltage of the charged object surface located upstream of the charge control member, Vo(ii) is a voltage of the charged object surface located downstream of the charge control member and upstream of the charging member, and Vo(iii) is a voltage of the charged object surface located downstream of the charging member.

In addition to the third aspect of the present invention, the voltage applying section applies a pulsating voltage obtained by superimposing a voltage component of a direct current on a voltage component that periodically changes between the charge control member and the object to be charged and/or between the charging member and the object to be charged, wherein a relation of $$|V\text{max}-Vo|>|Vth|>Vpp$$

is satisfied, where

Vth is a charging start voltage value of the object to be charged,

Vo is any one of the surface voltages Vo(i), Vo(ii) and Vo(iii) of the object to be charged, Vmax is a maximum value of the pulsating voltage, and Vpp is a peak-to-peak voltage value of the pulsating voltage.

The relation of |Vmax−Vo|>|Vth| allows regular charging to be carried out to the object to be charged during applying a bias by the charge control member, where Vo is any one of the surface voltages Vo(i), Vo(ii) and Vo(iii) of the object to be charged under the condition of |Vo(i)|<|Vo(ii)|<|Vo(iii)|. Also, the relation of |Vth|>Vpp prevents the opposite charge from being imparted to the residual toner on the object to be charged. Thus the charge property of the residual toner is stabilized, which eliminates the possibility of causing defective charging.

A fourth aspect of the present invention provides an image forming apparatus of an electrophotographic system, comprising:

a charging device for uniformly charging an outer circumferential surface of an electrostatic latent image carrier rotated as an object to be charged, the charging device are in accordance with any one of the first, second and third aspects of the invention;

an exposure device for forming a latent image by exposing the outer circumferential surface of the electrostatic latent image carrier;

a developing device for developing the latent image by making toner adhere to the latent image; and a transfer device for transferring the toner onto an object to receive transfer.

The image forming apparatus according to the fourth aspect of the invention has the same effects and advantages as those of the first, second and third aspects of the invention.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
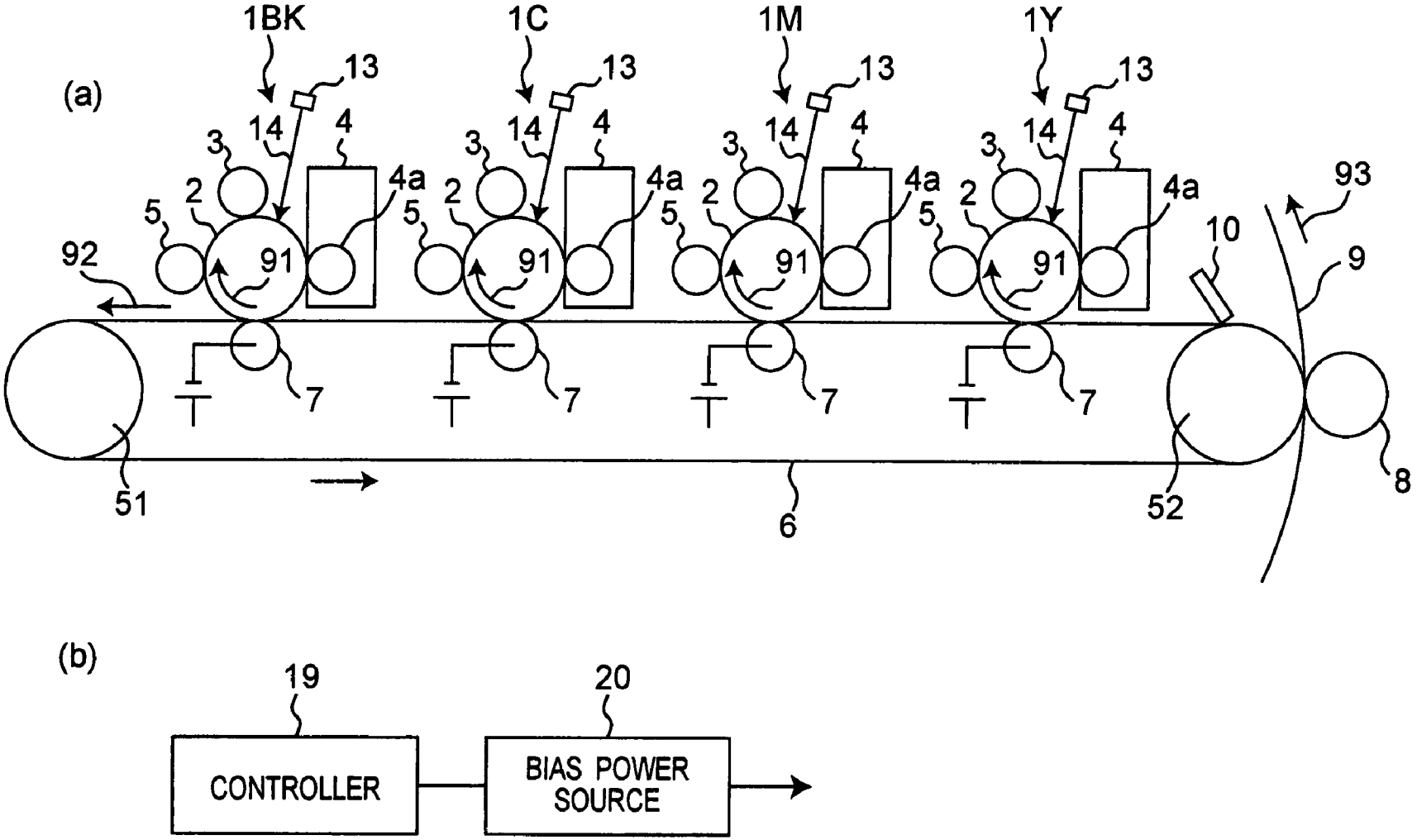
FIG. 1A is a view showing a schematic construction of a tandem type image forming apparatus of an electrophotographic system provided with a charging device according to one embodiment of this invention.
FIG. 1B is a view showing a controller and a bias power source of the image forming apparatus.

FIG. 1A shows a schematic construction of a tandem type image forming apparatus of an electrophotographic system provided with a charging device according to one embodiment of this invention. The image forming apparatus is, specifically, a copier a printer, a facsimile, a composite apparatus of these apparatuses or the like. Although the tandem type image forming apparatus is illustrated in the present embodiment, the image forming method is not limited to the tandem type.

As shown in FIG. 1A, this image forming apparatus is provided with an intermediate transfer belt 6, which is wound around two rollers 51 and 52 and circulated in the direction of arrow 92, and image forming units 1Y, 1M, 1C and 1BK of the four colors of yellow (Y), magenta (M), cyan (C) and black (Bk), which are arranged in this order from the upstream side on this intermediate transfer belt 6.

For example, the image forming unit 1Y of yellow (Y) is provided with a charge control member 5, a charging member 3, an exposure unit 13, a developing unit 4 and a primary transfer unit 7, which are arranged in this order around a photoreceptor drum (rotated in the direction of arrow 91 by an unshown motor) 2 that serves as an object to be charged and an electrostatic latent image carrier. In this example, the charge control member 5 and the charging member 3 are each constructed of a conductive roller that is brought in contact or proximity with the surface of the photoreceptor drum 2. The charge control member 5 and the charging member 3 stabilize the charge property of the residual toner on the photoreceptor drum 2 by the method described later and uniformly charge the surface of the photoreceptor drum 2. The exposure unit 13 is constructed of, for example, a semiconductor laser device and exposes the surface of the uniformly charged photoreceptor drum 2 to light to form a latent image there. The developing unit 4 develops an image by making toner (yellow toner in this image forming unit 1Y) adhere to the latent image. In this example, the developing unit 4 is a contact developing device having a developing roller 4*a* that is brought in contact or proximity with the surface of the photoreceptor drum and operates also as a toner collecting section for collecting the toner that remains on the surface of the photoreceptor drum (so-called the cleanerless system). The primary transfer unit 7 has a transfer roller opposed to the photoreceptor drum 2 with interposition of the intermediate transfer belt 6 and transfers the toner on the surface of the photoreceptor drum onto the intermediate transfer belt 6 that serves as a transfer member by applying a prescribed bias voltage to this transfer roller.

The image forming units 1M, 1C and 1BK of the other colors have the same construction as that of the image forming unit 1Y except for the difference in the color of toner. The colors are overlaid every time the intermediate transfer belt 6 passes along each of the image forming units, and a full color image is finally formed on the intermediate transfer belt 6.

A secondary transfer unit 8 constructed of a transfer roller is provided in a position on the downstream side of the image forming units 1Y, 1M, 1C and 1BK of the four colors or in a position opposed to the roller 52 with interposition of the intermediate transfer belt 6 in this example. The secondary transfer unit 8 collectively transfers the color image on the intermediate transfer belt onto a sheet 9 of paper or the like by applying a prescribed bias voltage to the transfer roller. The sheet 9, onto which the color image has been transferred, is conveyed upward as indicated by arrow 93 and made to pass through a fixing section (not shown) to fix the color image.

A cleaning blade 10 is provided above the roller 52. The toner, which remains on the intermediate transfer belt 6 after the secondary transfer process, is removed from the intermediate transfer belt 6 by this cleaning blade 10, conveyed by a conveyance screw (not shown) and collected into a waste toner container (also not shown).

Moreover, as shown in FIG. 1B, this image forming apparatus is provided with a controller 19 for controlling the total operation of this apparatus and a bias power source 20 for supplying an electric power to each of the sections of this image forming apparatus in accordance with instructions from this controller 19. Prescribed voltages are supplied from this bias power source 20 to the charge control member 5, the charging member 3, the developing unit 4, the primary transfer unit 7, the secondary transfer unit 8 and so on. This bias power source 20 is able to supply a pulsating voltage Vsp that is obtained by superimposing a dc voltage component Vdc on a rectangular wave voltage component Vac that periodically changes.

In this embodiment, the maximum value, the minimum value and the peak-to-peak voltage value of the pulsating voltage Vsp are expressed as Vmax, Vmin and Vpp, respectively. It is to be noted that $Vpp=|Vmax-Vmin|$. The cycle of the voltage component Vac that periodically changes is assumed to be sufficiently smaller than the period during which the surface of the photoreceptor drum 2 passes along each of the members.

If opposite charge is imparted (injected) from the charging member 3 to the toner that remains on the surface of the photoreceptor drum 2 during the transfer process, it is possible that the toner adheres to the charging member 3 brought in contact with the surface of the photoreceptor drum 2 to cause defective charging or the toner collection in the contact developing device becomes insufficient to generate a defective image. Accordingly, in order to prevent the opposite charge from being imparted to the residual toner on the photoreceptor drum 2, this image forming apparatus applies a bias voltage between the charge control member 5 and the photoreceptor drum 2 and between the charging member 3 and the photoreceptor drum 2 as follows.

It is to be noted that the photoreceptor drum 2 is constituted by providing a known photoconductive semiconductor material layer of an organic semiconductor, amorphous silicon, selenium or the like on the outer peripheral surface of a cylindrical conductor drum. The conductor drum of this photoreceptor drum 2 is grounded.

FIRST EXAMPLE OF BIAS APPLICATION

Figure 4:
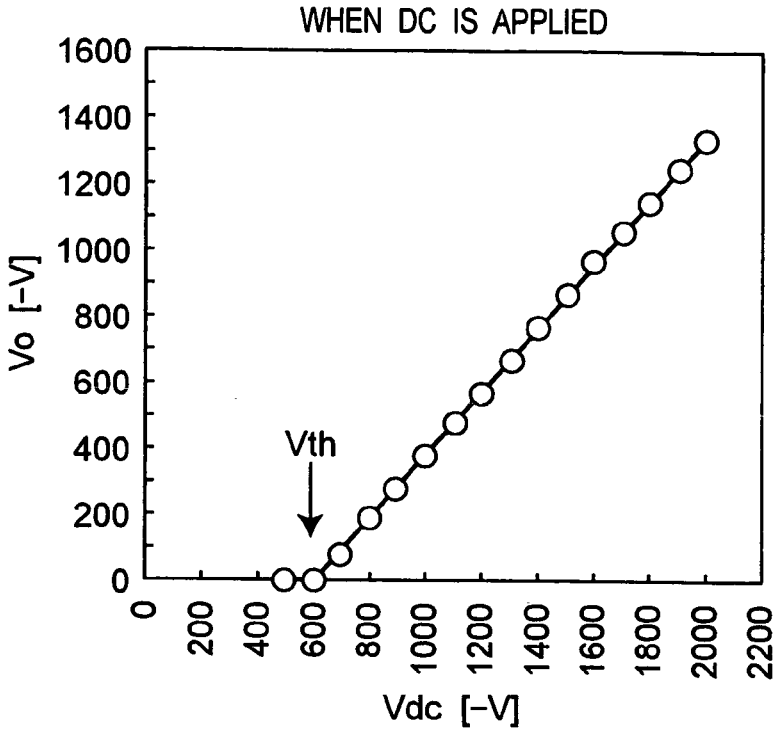
FIG. 4 is a graph showing the relation of a direct current application voltage Vdc and the photoreceptor surface voltage Vo between a charging member and a photoreceptor drum.

As a precondition, a surface voltage (hereinafter referred to as a "photoreceptor surface voltage") Vo that the photoreceptor drum 2 assumed when the dc voltage Vdc was applied to the charging member 3 was first measured (Vdc versus Vo characteristic) as shown in FIG. 4. The photoreceptor drum 2 started charging from $Vdc \approx -600$ V (charging start voltage $Vth=-600$ V). In a region where $|Vdc|$ is greater than $|Vth|$, the voltages Vdc and Vo showed an almost linear relation.

Figure 5:
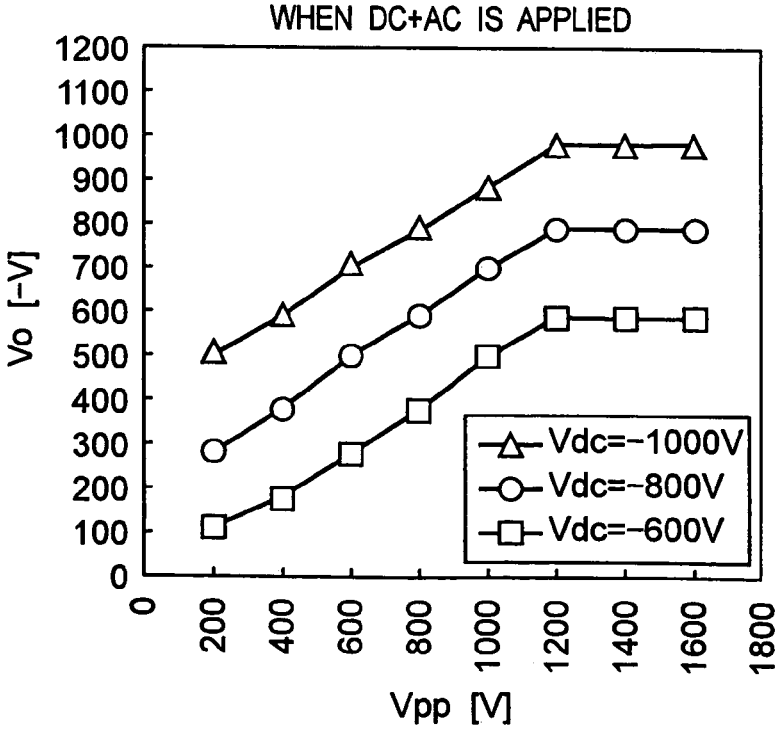
FIG. 5 is a graph showing the relation between a peak-to-peak voltage value Vpp of a pulsating voltage and the photoreceptor surface voltage Vo when the pulsating voltage is applied to the charging member with the dc voltage component Vdc served as a parameter.

Moreover, as shown in FIG. 5, the relation between the peak-to-peak voltage value Vpp of the pulsating voltage and the photoreceptor surface voltage Vo when the pulsating voltage (Vdc+Vac) was applied to the charging member 3 was measured with the voltage Vdc served as a parameter. The Vo value linearly increases in proportion to the Vpp value in the region where the Vpp value is small, and the Vo value saturates and becomes an approximately constant value (the saturated Vo value is approximately equal to the Vdc value) when the Vpp value exceeds a certain value. A boundary between the region where the Vo value is proportional to the Vpp value and the saturation region is equal to approximately double the value (2Vth) of the Vth value when the dc voltage is applied.

Figure 3:
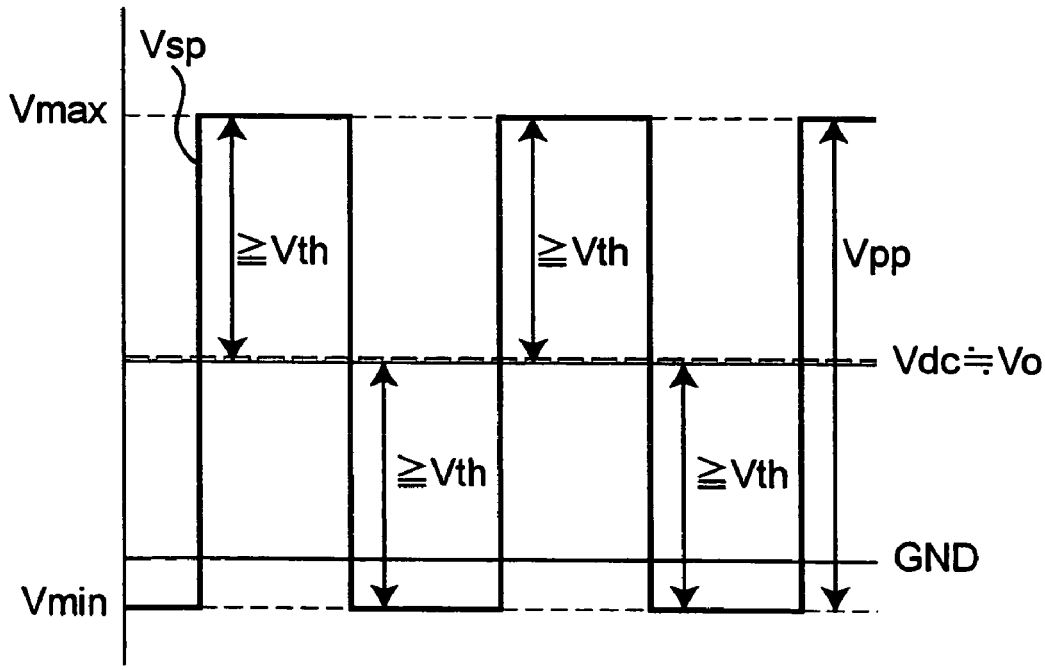
Fig.3 PRIOR ART
FIG. 3 is a graph showing a surface voltage Vo of a photoreceptor after reaching the charging member according to a prior art example of bias application.

FIG. 3 shows for reference the photoreceptor surface voltage Vo after the photoreceptor has reached the charging member when the relation $Vpp \geqq 2Vth$ as disclosed in the first patent document JP 63-149668A is satisfied. In the graph, the horizontal axis represents time, and the vertical axis represents voltage. In correspondence with the results shown in FIG. 5, the Vo value has already become approximately equal to the Vdc value upon receiving the bias application. On such the bias application condition, the regular charging is carried out for the photoreceptor drum 2 when $Vmax-Vo \geqq Vth$ while reverse charging (removal of electricity) is carried out for the photoreceptor drum 2 when $Vmin-Vo \geqq Vth$. The technique of the first patent document JP 63-149668A is intended for uniforming the photoreceptor surface voltage Vo by this reverse charging (removal of electricity), by which the opposite charge is imparted (injected) to the residual toner on the photoreceptor drum 2. Therefore, as already described, it becomes difficult to achieve uniform charging as a consequence of toner adhesion to the charging member or reliable toner collection is not carried out in the toner collecting section, (developing section), therefore causing a defective image.

Figure 2:
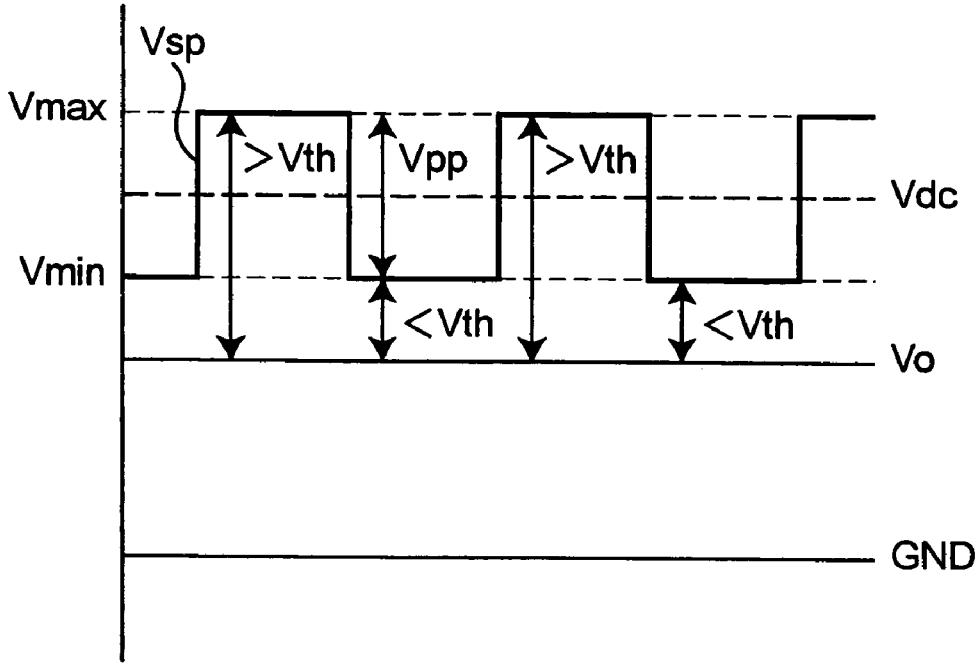
FIG. 2 is a graph showing a first example of bias application of the above image forming apparatus.

Accordingly, in this first example of bias application, as shown in FIG. 2, it is assumed that there is satisfied the relation:

$$Vpp \leqq |Vth| \leqq |Vdc| \quad (1)$$

between the pulsating voltage $Vsp=Vdc+Vac$ applied to the charging member 3 and the charging start voltage value Vth of the photoreceptor drum 2. FIG. 2 shows the photoreceptor surface voltage Vo after the photoreceptor has reached the charging member 3. In the graph, the horizontal axis represents time, and the vertical axis represents voltage. As already described, $Vpp=|Vmax-Vmin|$, where Vmax and Vmin represent the maximum value and the minimum value, respectively, of the pulsating voltage Vsp.

The expression that "after the photoreceptor has reached" the charging member 3 implies the inclusion of the time when the photoreceptor is passing along the charging member 3 and has already received the bias applied and the time after the photoreceptor has passed along the charging member 3 (this hereinafter holds same).

With regard to the developing system of the developing unit 4, examples of voltage values in the case of the reverse developing system that uses toner of the same polarity (negative polarity in this case) as the charge polarity of the photoreceptor drum 2 are as follows.

First of all, with regard to the pulsating voltage Vsp applied to the charging member 3, $Vdc=-900$ V, $Vmax=-1100$ V, $Vmin=-700$ V and $Vpp=400$ V.

With regard to the photoreceptor drum 2, the charging start voltage Vth between the drum 2 and the charging member 3 is −600 V, that is, Vth=−600 V.

With regard to the surface voltage Vo of the photoreceptor drum 2, Vo=−500 V (after the photoreceptor drum has reached the charging member 3).

Figure 6:
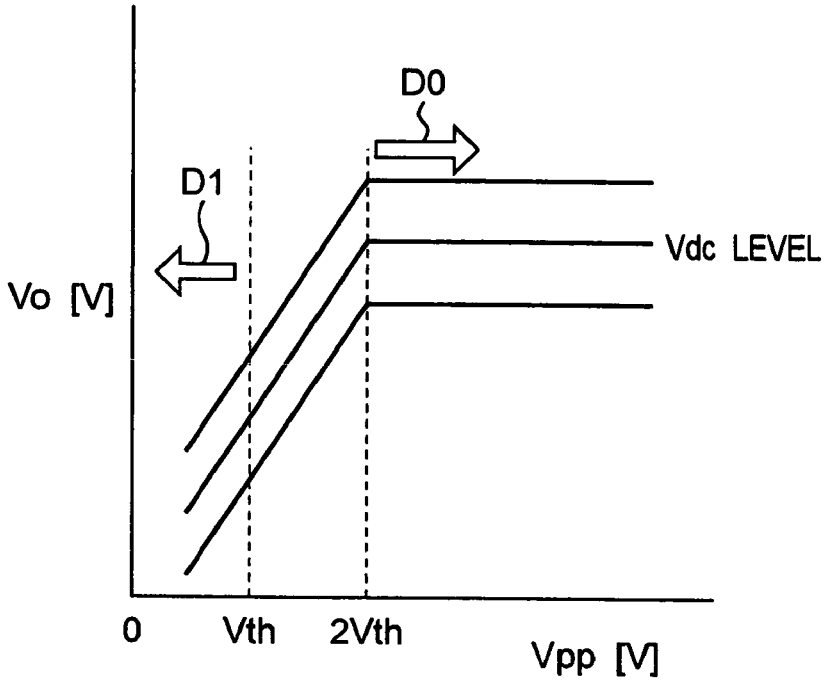
FIG. 6 is a graph showing a comparison between a bias region used in the prior art example of bias application shown in FIG. 3 and a bias region used in the first example of bias application shown in FIG. 2.

As shown in FIG. 6, in contrast to the prior art example shown in FIG. 3 that uses a region DO where Vpp≧2|Vth|, this first example of bias application is characterized in that it uses a region DI where Vpp≦|Vth|, i.e., a region where the Vo value linearly increases in proportion to the Vpp value.

According to the bias application condition of the expression (1), the regular charging is carried out for the photoreceptor drum 2 when |Vmax−Vo|>|Vth|, whereas the reverse charging (removal of electricity) is not carried out for the photoreceptor drum 2 when |Vmin−Vo|<|Vth|. Therefore, opposite charge is prevented from being imparted to the residual toner on the photoreceptor drum 2, and the charge property of the residual toner is stabilized. As a result, toner adhesion to the charging member 3 is prevented, causing no defective charging. As a result, the image quality can be maintained satisfactory for a long term. Moreover, the developing unit 4 operates as a toner collecting section to carry out reliable toner collection. Accordingly, there is no need to separately provide a cleaner device in order to collect the toner that remains on the surface of the photoreceptor drum after transfer by the primary transfer unit 7. Even if such the cleaner device is eliminated as in this image forming apparatus, the image quality can be maintained satisfactory for a long term.

Furthermore, there is no need to provide cleaning means (mechanical or electrical technique) intended for cleaning the charging member 3. Moreover, this image forming apparatus, which regulates the peak-to-peak voltage value Vpp of the pulsating voltage Vsp, therefore does not require the complicated control of switching the discharge electric field or the like. Therefore, this image forming apparatus is constructed simple at low cost.

Figure 7:
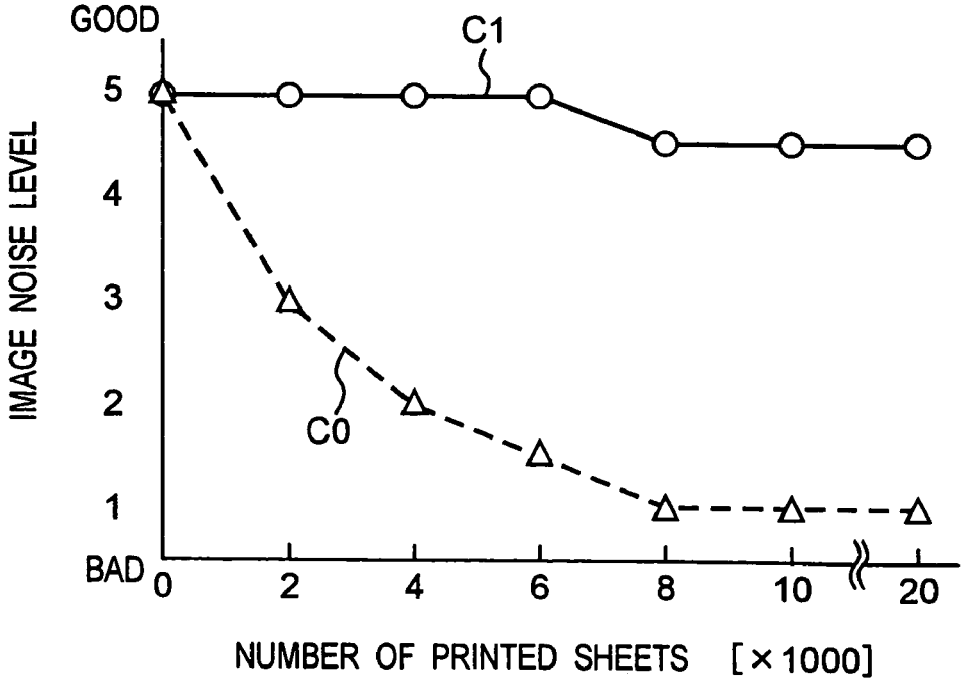
FIG. 7 is a graph showing a comparison between the first example of bias application shown in FIG. 2 and the prior art example of bias application shown in FIG. 3 with regard to test results of printing durability.

FIG. 7 shows a comparison between the case where the bias application condition of the expression (1) is used and the case where the conventional bias application condition shown in FIG. 3 is used with regard to test results of printing durability. In the graph, the horizontal axis represents the number of printed sheets (unit: 1000 sheets), and the vertical axis represents noise levels evaluating image noise in five steps. When the conventional bias application condition shown in FIG. 3 is used, the noise level three occurs when 2000 sheets have been printed due to the contamination (toner contamination) of the charging member (conductive roller) 3 as indicated by the dashed line graph C0, and the image noise subsequently deteriorates to the level one. In contrast to this, when the bias application condition of the expression (1) is used, the level four or higher level is maintained up to 20000 sheets as indicated by the solid line graph C1.

The bias application condition of the expression (1) is applied to the charging member 3 in this first example of bias application. However, the bias application condition of the expression (1) can be applied not only to the charging member 3 but also to all the electric charge means including the charge control member 5, and similar operative effects can be produced.

SECOND EXAMPLE OF BIAS APPLICATION

Figure 8:
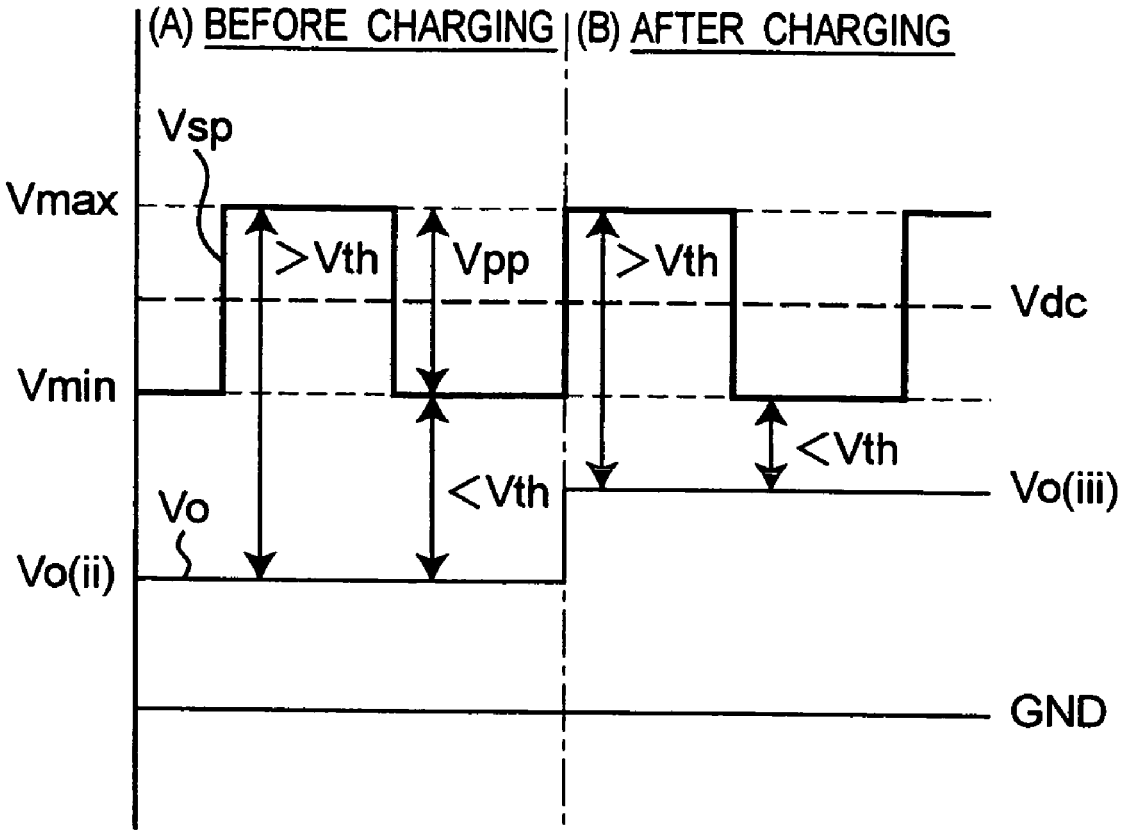
FIG. 8 is a graph showing a second example of bias application of the above image forming apparatus.

FIG. 8 shows the second example of bias application. In this second example of bias application, there is satisfied the relations:

$$|Vmax-Vo|>|Vth|>|Vmin-Vo| \quad (2)$$

$$|Vmin|\geqq|Vo| \quad (3)$$

between the pulsating voltage Vsp=Vdc+Vac applied to the charging member 3 and the charging start voltage value Vth of the photoreceptor drum 2. The photoreceptor surface voltage Vo before the photoreceptor reaches the charging member 3 is indicated by Vo(ii) in the left half (A) of FIG. 8, and the photoreceptor surface voltage Vo after the photoreceptor has reached the charging member 3 is indicated by Vo(iii) in the right half (B) of FIG. 8. In the graph, the horizontal axis represents time, and the vertical axis represents voltage. As already described, Vmax and Vmin represent the maximum value and the minimum value, respectively, of the pulsating voltage Vsp.

With regard to the developing system of the developing unit 4, examples of voltage values in the case of the reverse developing system that uses toner of the same polarity (negative polarity in this case) as the charge polarity of the photoreceptor drum 2 are as follows.

First of all, with regard to the pulsating voltage Vsp applied to the charging member 3, Vdc=−900 V, Vmax=−1100 V, Vmin=−700 V and Vpp=400 V.

With regard to the photoreceptor drum 2, the charging start voltage Vth between the drum 2 and the charging member 3 is −600 V, that is, Vth=−600 V.

With regard to the surface voltage Vo of the photoreceptor drum 2, Vo=−500 V (after the photoreceptor drum has reached the charging member 3).

According to the bias application condition of the expression (2), the regular charging is carried out for the photoreceptor drum 2 when |Vmax−Vo|>|Vth|, whereas the reverse charging (removal of electricity) is not carried out for the photoreceptor drum 2 when |Vmin−Vo|<|Vth| similarly to the bias application condition of the expression (1). Therefore, the opposite charge is prevented from being imparted to the residual toner on the photoreceptor drum 2 when the residual toner passes along the charging member 3, and the charge property of the residual toner is stabilized. As a result, toner adhesion to the charging member 3 is prevented, causing no defective charging. As a result, the image quality can be maintained satisfactory for a long term. Moreover, the developing unit 4 operates as a toner collecting section to carry out reliable toner collection. Accordingly, there is no need to separately provide a cleaner device in order to collect the toner that remains on the surface of the photoreceptor drum after transfer by the primary transfer unit 7. Even if such the cleaner device is eliminated as in this image forming apparatus, the image quality can be maintained satisfactory for a long term.

Furthermore, there is no need to provide cleaning means (mechanical or electrical technique) intended for cleaning the charging member 3. Moreover, this image forming apparatus, which regulates the peak-to-peak voltage value Vpp of the pulsating voltage Vsp, therefore does not require the complicated control of switching the discharge electric field or the like. Therefore, this image forming apparatus is constructed simple at low cost.

The reason that the bias application condition of the expression (3), i.e., the relation |Vmin|≧|Vo| should be satisfied is as follows.

Figure 9:
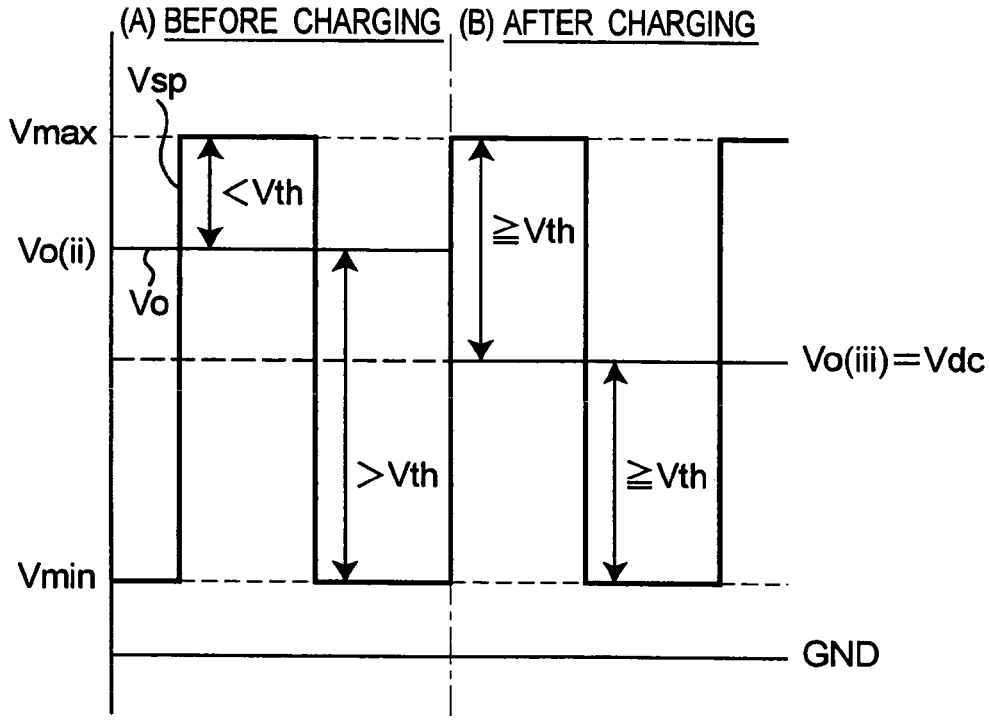
FIG. 9 is a graph showing an example of bias application different from the second example of bias application shown in FIG. 8.
Figure 10:
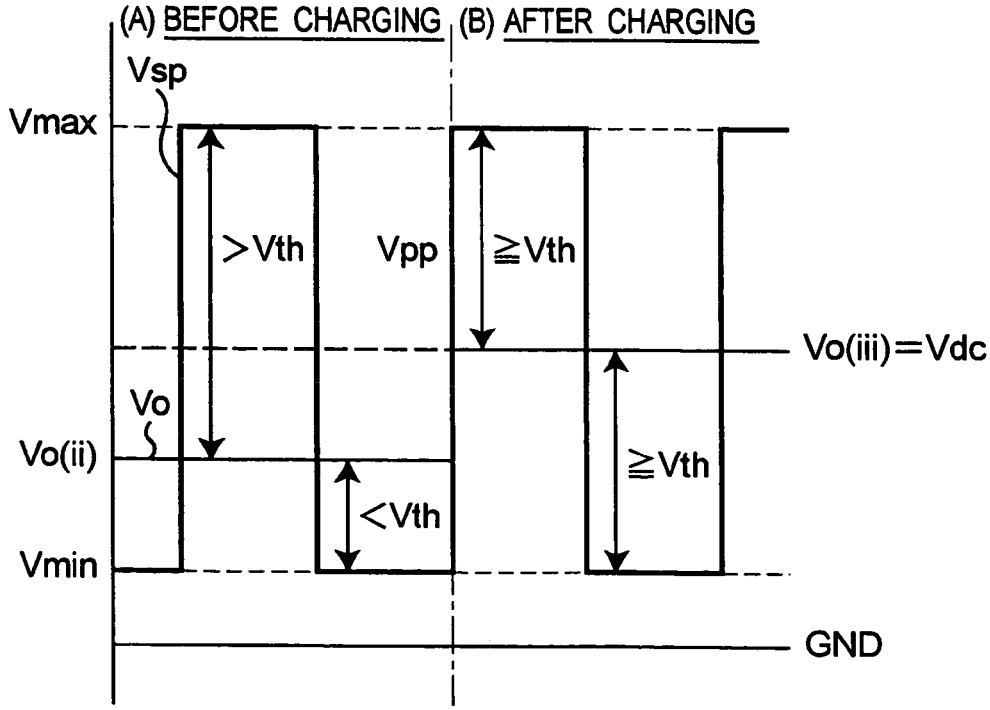
FIG. 10 is a graph showing another example of bias application different from the second example of bias application shown in FIG. 8.

FIGS. 9 and 10 show for reference bias application examples such that the bias application condition of the expression (3), i.e., the relation $|Vmin| \geqq |Vo|$ is not satisfied. Assuming that the photoreceptor surface voltage Vo before the photoreceptor reaches the charging member 3 is indicated by Vo(ii) and the photoreceptor surface voltage Vo after the photoreceptor has reached the charging member 3 is indicated by Vo(iii), then FIG. 9 corresponds to the case where $|Vo(ii)|>|Vo(iii)|$, and FIG. 10 corresponds to the case where $|Vo(ii)|<|Vo(iii)|$.

As is apparent from the left half (A) of FIG. 9, the bias relation is established so that the charging is not carried out for the photoreceptor drum 2 when $|Vmax-Vo|<|Vth|$ before the photoreceptor drum reaches the charging member 3, and the reverse charging (removal of electricity) is carried out for the photoreceptor drum 2 when $|Vmin-Vo|>|Vth|$. As shown in the right half (B) of FIG. 9, this bias relation is similar even after the photoreceptor drum has reached the charging member 3. Therefore, the opposite charge is imparted (injected) to the residual toner on the photoreceptor drum 2 when $|Vmin-Vo|>|Vth|$. As a result, it becomes difficult to achieve uniform charging as a consequence of toner adhesion to the charging member 3 or reliable toner collection is not carried out in the toner collecting section (developing unit 4), therefore causing a defective image.

Moreover, as is apparent from the left half (A) of FIG. 10, the bias relation is established so that the regular charging is carried out for the photoreceptor drum 2 when $|Vmax-Vo|>|Vth|$ before the photoreceptor drum reaches the charging member 3, and the reverse charging (removal of electricity) is not carried out for the photoreceptor drum 2 when $|Vmin-Vo|<|Vth|$. However, as shown in the right half (B) of FIG. 10, the opposite charge is imparted (injected) to the residual toner on the photoreceptor drum 2 when $|Vmin-Vo|>|Vth|$ after the photoreceptor drum has reached the charging member 3. As a result, it becomes difficult to achieve uniform charging as a consequence of toner adhesion to the charging member 3 or reliable toner collection is not carried out in the toner collecting section (developing unit 4), therefore causing a defective image.

As described above, when the relation $|Vmin| \geqq |Vo|$ is not satisfied, the opposite charge is to be imparted to the residual toner on the photoreceptor drum 2 when the photoreceptor drum passes along the charging member 3. Therefore, in order to prevent the opposite charge from being imparted to the residual toner on the photoreceptor drum 2, it is preferable to satisfy the bias application condition of the expression (3), i.e., the relation $|Vmin| \geqq |Vo|$.

Figure 11:
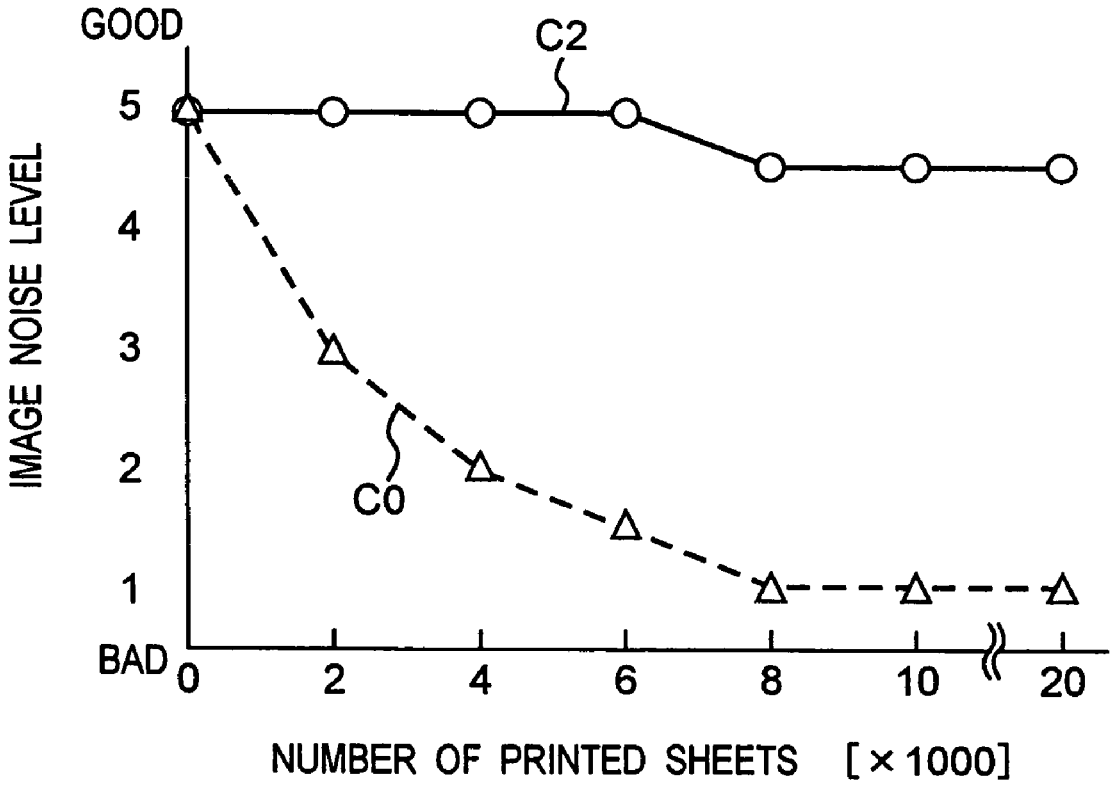
FIG. 11 is a graph showing a comparison between the second example of bias application shown in FIG. 8 and the prior art example of bias application shown in FIG. 3 with regard to test results of printing durability.

FIG. 11 shows a comparison between the case where the bias application conditions of the expressions (2) and (3) are used and the case where the conventional bias application condition shown in FIG. 3 is used with regard to test results of printing durability. In the graph, the horizontal axis represents the number of printed sheets (unit: 1000 sheets), and the vertical axis represents noise levels evaluating image noise in five steps. When the conventional bias application condition shown in FIG. 3 is used, the noise level three occurs when 2000 sheets have been printed due to the contamination (toner contamination) of the charging member (conductive roller) 3 as indicated by the dashed line graph C0, and the image noise subsequently deteriorates to the level one. In contrast to this, when the bias application conditions of the expressions (2) and (3) are used, the level four or higher level is maintained up to 20000 sheets as indicated by the solid line graph C2.

The bias application conditions of the expressions (2) and (3) are applied to the charging member 3 in this second example of bias application. However, the bias application conditions of the expressions (2) and (3) can be applied not only to the charging member 3 but also to all the electric charge means including the charge control member 5, and similar operative effects can be produced.

THIRD EXAMPLE OF BIAS APPLICATION

Figure 12:
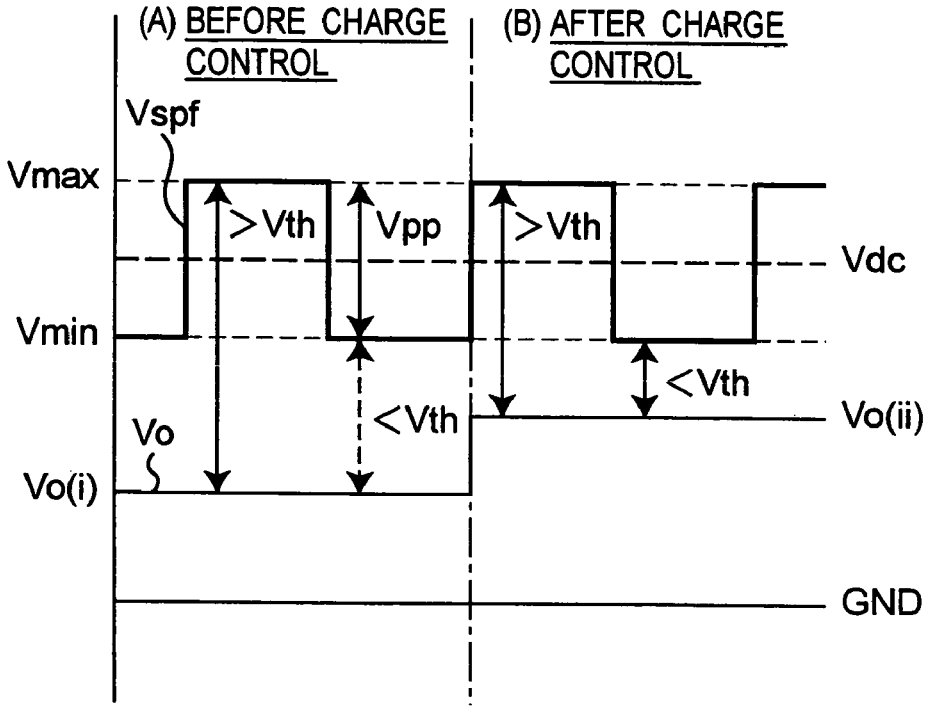
FIG. 12 is a graph showing a third example of bias application of the above image forming apparatus.

FIG. 12 shows the third example of bias application. In this third example of bias application, assuming that the surface voltage of the photoreceptor drum 2 before the photoreceptor drum reaches the charge control member 5 after the transfer process by the primary transfer unit 7 is Vo(i) as shown in the left half (A) of FIG. 12 and the surface voltage of the photoreceptor drum 2 before the photoreceptor drum reaches the charging member 3 after the photoreceptor drum has reached the charge control member 5 is Vo(ii) as shown in the right half (B) of FIG. 12, then there is shown the example that satisfies the relation:

$$|Vo(i)|<|Vo(ii)| \tag{4}$$

and the relation:

$$|Vmax-Vo|>|Vth|>Vpp \tag{5}$$

between the pulsating voltage applied to the charge control member 5 (this voltage is expressed as Vspf in order to distinguish this from the pulsating voltage Vsp applied to the charging member 3) and the charging start voltage value Vth of the photoreceptor drum 2. In the graph, the horizontal axis represents time, and the vertical axis represents voltage. It is to be noted that Vmax and Vmin represent the maximum value and the minimum value, respectively, of the pulsating voltage Vspf.

The expression that "after the photoreceptor drum has reached" the charge control member 5 implies the inclusion of the time when the photoreceptor drum is passing along the charge control member 5 and has already received the bias applied and the time after the photoreceptor drum has passed along the charge control member 5 (this hereinafter holds same).

With regard to the developing system of the developing unit 4, examples of voltage values in the case of the reverse developing system that uses toner of the same polarity (negative polarity in this case) as the charge polarity of the photoreceptor drum 2 are as follows.

First of all, with regard to the pulsating voltage Vspf applied to the charge control member 5, Vdc=−900 V, Vmax=−1100 V, Vmin=−700 V and Vpp=400 V.

Moreover, with regard to the photoreceptor drum 2, the charging start voltage Vth=−600 V between the drum and the charge control member 5.

With regard to the surface voltage Vo of the photoreceptor drum 2, Vo(i)=−300 V and Vo(ii)=−500 V.

As is apparent from FIG. 12, the bias relation is established so that the regular charging is carried out for the photoreceptor drum 2 when $|Vmax-Vo|>|Vth|$ before and after the photoreceptor drum reaches or has reached the charge control member 5, and the reverse charging (removal of electricity) is not carried out for the photoreceptor drum 2 when $|Vmin-Vo|<|Vth|$. Therefore, opposite charge is prevented from being imparted to the residual toner on the photoreceptor drum 2 when the residual toner passes along the charge control member 5, and the charge property of the residual toner is stabilized. As a result, the toner adhesion to the charging member 3 is prevented, causing no defective charging. As a result, the image quality can be maintained satisfactory for a long term. Moreover, the developing unit 4 operates as a toner collecting section to carry out reliable toner collection. Accordingly, there is no need to separately provide a cleaner device in order to collect the toner that remains on the surface of the photoreceptor drum after transfer by the primary transfer unit 7. Even if such the cleaner device is eliminated as in this image forming apparatus, the image quality can be maintained satisfactory for a long term.

Furthermore, there is no need to provide cleaning means (mechanical or electrical technique) intended for cleaning the charging member 3. Moreover, this image forming apparatus, which regulates the peak-to-peak voltage value Vpp of the pulsating voltage Vsp, therefore does not require the complicated control of switching the discharge electric field or the like. Therefore, this image forming apparatus is constructed simple at low cost.

Figure 13:
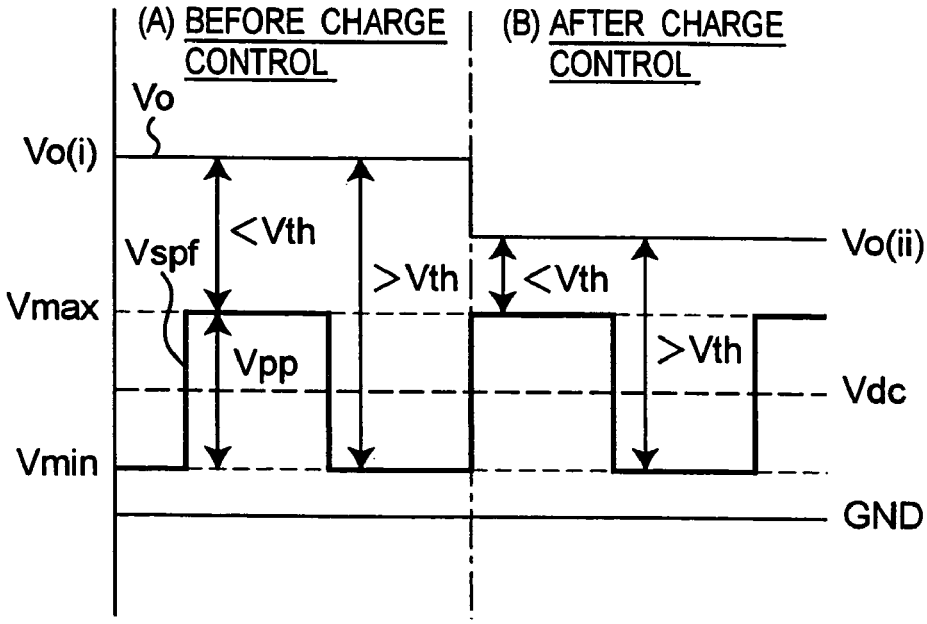
FIG. 13 is a graph showing an example of bias application different from the third example of bias application shown in FIG. 12.
Figure 14:
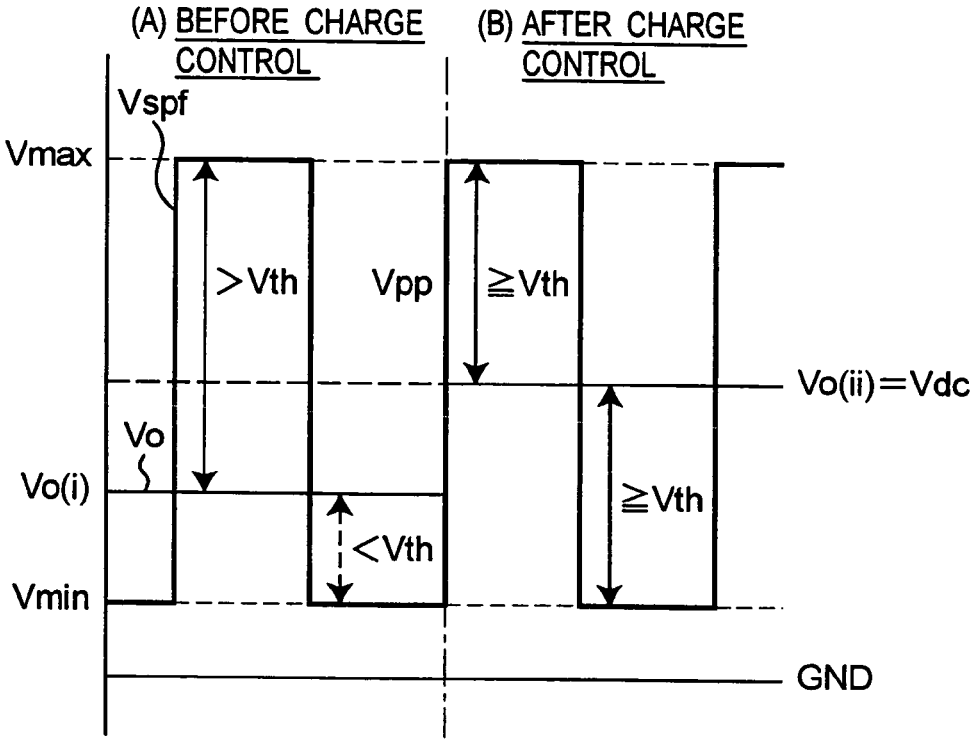
FIG. 14 is a graph showing another example of bias application different from the third example of bias application shown in FIG. 12.
Figure 15:
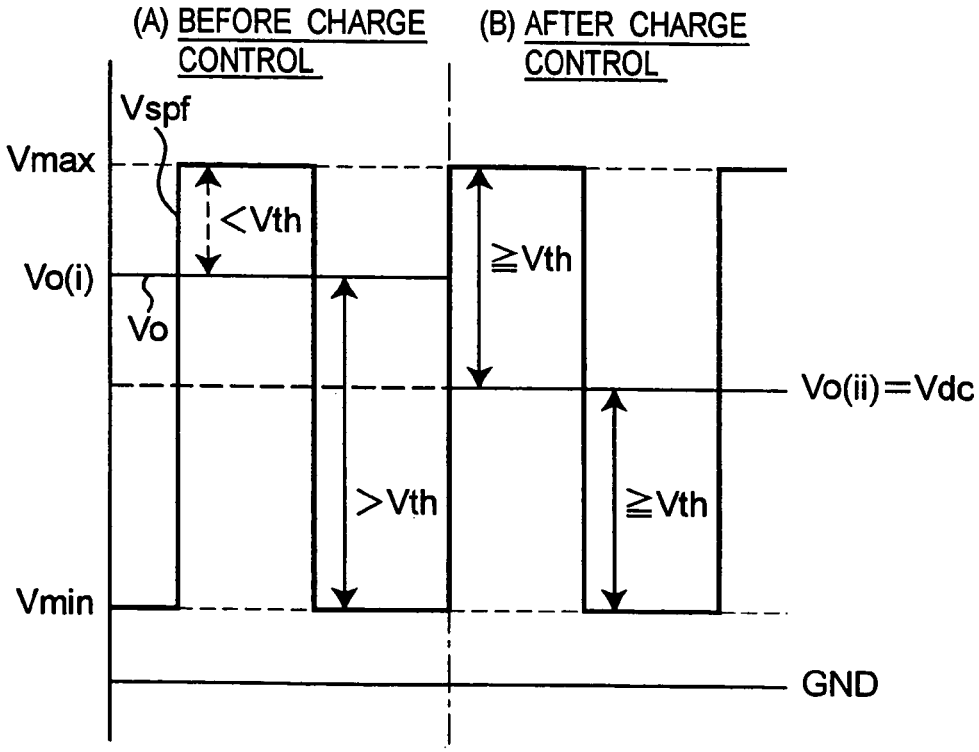
FIG. 15 is a graph showing yet another example of bias application different from the third example of bias application shown in FIG. 12.

FIGS. 13, 14 and 15 show for reference bias application examples such that the bias application conditions of the expressions (4) and (5) are not satisfied.

First of all, FIG. 13 shows a bias application condition such that $$|Vo(i)|>|Vo(ii)|, \text{ and}$$

$$|V\text{min}-Vo|>|Vth|>Vpp.$$

In this example of bias application of FIG. 13, the bias relation is established so that the regular charging is not carried out for the photoreceptor drum 2 when |Vmax−Vo|<|Vth| before and after the photoreceptor drum reaches or has reached the charge control member 5, and the reverse charging (removal of electricity) is carried out for the photoreceptor drum 2 when |Vmin−Vo|>|Vth|. Therefore, opposite charge is imparted (injected) to the residual toner on the photoreceptor drum 2 when |Vmin−Vo|>|Vth|. As a result, it becomes difficult to achieve uniform charging as a consequence of toner adhesion to the charging member or reliable toner collection is not carried out in the toner collecting section (developing section), therefore causing a defective image.

Next, FIG. 14 shows a bias application condition such that $$|Vo(i)|<|Vo(ii)|, \text{ and}$$

$$|V\text{max}-Vo|\geqq|V\text{min}-Vo|\geqq|Vth|.$$

In this example of bias application, as shown in the left half (A) of FIG. 14, the bias relation is established so that the regular charging is carried out for the photoreceptor drum 2 when |Vmax−Vo|>|Vth| before the photoreceptor drum reaches the charge control member 5, and reverse charging (removal of electricity) is not carried out for the photoreceptor drum 2 when |Vmin−Vo|<|Vth|. However, as shown in the right half (B) of FIG. 14, the bias relation is established so that the regular charging is carried out for the photoreceptor drum 2 when |Vmax−Vo|≧|Vth| after the photoreceptor drum has reached the charge control member 5, and the opposite charge is imparted (injected) to the residual toner on the photoreceptor drum 2 when |Vmin−Vo|≧|Vth|. As a result, it becomes difficult to achieve uniform charging as a consequence of toner adhesion to the charging member or reliable toner collection is not carried out in the toner collecting section (developing section), therefore causing a defective image.

Next, FIG. 15 shows a bias application condition such that $$|Vo(i)|>|Vo(ii)|, \text{ and}$$

$$|V\text{min}-Vo|\geqq|V\text{max}-Vo|\geqq|Vth|.$$

In this example of bias application, as shown in the left half (A) of FIG. 15, the bias relation is established so that reverse charging (removal of electricity) is carried out for the photoreceptor drum 2 when |Vmin−Vo|>|Vth| before the photoreceptor drum reaches the charge control member 5. Moreover, as shown in the right half (B) of FIG. 15, the regular charging is carried out for the photoreceptor drum 2 when |Vmax−Vo|≧|Vth| after the photoreceptor drum has reached the charge control member 5, and the opposite charge is imparted (injected) to the residual toner on the photoreceptor drum 2 when |Vmin−Vo|≧|Vth|. As a result, it becomes difficult to achieve uniform charging as a consequence of toner adhesion to the charging member or reliable toner collection is not carried out in the toner collecting section (developing section), therefore causing a defective image.

As described above, in the case where the bias application condition of the aforementioned expression (4) or (5) is not satisfied, the opposite charge is to be imparted (injected) to the residual toner on the photoreceptor drum 2 when the photoreceptor drum passes along the charge control member 5. Therefore, it is preferable to satisfy the bias application conditions of the expressions (4) and (5) in order to prevent the opposite charge from being imparted to the residual toner on the photoreceptor drum 2.

In this third example of bias application, the bias application conditions of the expressions (4) and (5) are applied to the charge control member 5. However, the bias application conditions of the expressions (4) and (5) can be applied not only to the charge control member 5 but also to all the charging means including the charging member 3, and similar operative effects can be produced.

FOURTH EXAMPLE OF BIAS APPLICATION

Figure 16:
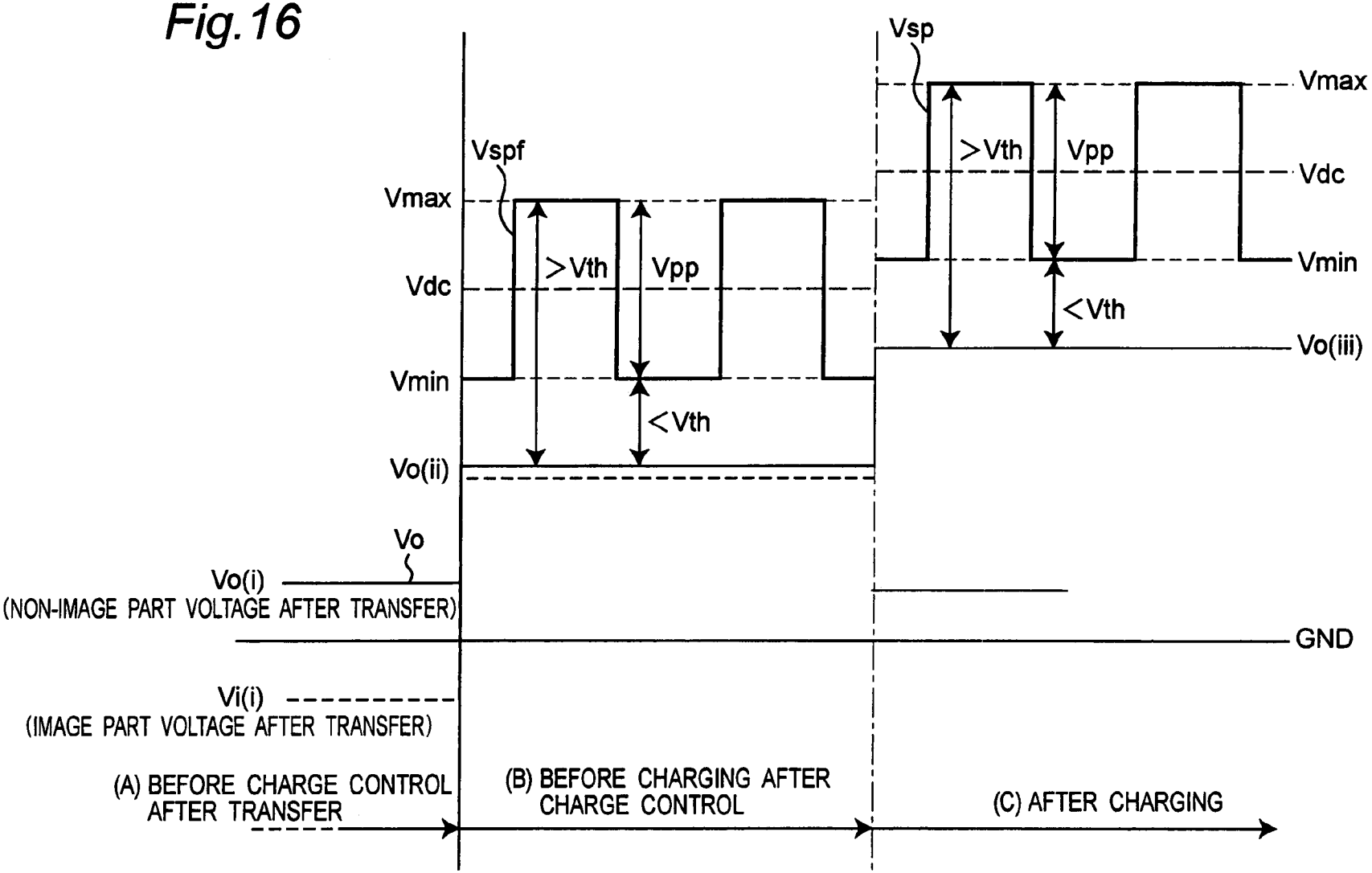
FIG. 16 is a graph showing a fourth example of bias application of the above image forming apparatus.

FIG. 16 shows the fourth example of bias application. In this fourth example of bias application, assuming that the surface voltage (non-image portion) of the photoreceptor drum 2 before the photoreceptor drum reaches the charge control member 5 after the transfer process by the primary transfer unit 7 is Vo(i) as shown in the left end portion (A) of this FIG. 16, the surface voltage of the photoreceptor drum 2 before the photoreceptor drum reaches the charging member 3 after the drum has reached the charge control member 5 is Vo(ii) as shown in the middle portion (B) of FIG. 16 and the surface voltage of the photoreceptor drum 2 after the photoreceptor drum has reached the charging member 3 is Vo(iii) as shown in the right end portion (C) of FIG. 16, then there is shown an example that satisfies the relation:

$$|Vo(i)|<|Vo(ii)|<|Vo(iii)| \tag{6}$$

and the relation:

$$|V\text{max}-Vo|>|Vth|>Vpp \tag{7}$$

between the pulsating voltage Vspf applied to the charge control member 5 and the charging start voltage value Vth of the photoreceptor drum 2 and between the pulsating voltage Vsp applied to the charging member 3 and the charging start voltage value Vth of the photoreceptor drum 2. In the graph, the horizontal axis represents time, and the vertical axis represents voltage. It is to be noted that Vmax and Vmin represent the maximum value and the minimum value of the pulsating voltages Vspf and Vsp, respectively. The voltage Vi(i) represents the surface voltage of the image portion of the photoreceptor drum 2 before the photoreceptor drum reaches the charge control member 5 after the transfer process by the primary transfer unit 7.

With regard to the developing system of the developing unit 4, examples of voltage values in the case of the reverse developing system that uses toner of the same polarity (negative polarity in this case) as the charge polarity of the photoreceptor drum 2 are as follows.

First of all, with regard to the pulsating voltage Vspf applied to the charge control member 5, Vdc=−500 V, Vmax=−700V, Vmin=−300 V and Vpp=400 V.

Next, with regard to the pulsating voltage Vsp applied to the charging member 3, Vdc=−900 V, Vmax=−1100 V, Vmin=−700 V and Vpp=400 V.

With regard to the photoreceptor drum 2, the charging start voltage value Vth between the drum and the charge control member 5 is Vth=−400 V, and the charging start voltage value Vth between the drum and the charging member 3 is Vth=−600 V.

With regard to the surface voltage Vo of the photoreceptor drum 2, Vo(i)=−100V, Vo(ii)=−300 V and Vo(iii)=−500 V.

As is apparent from FIG. 16, the bias relation is established so that the regular charging is carried out for the photoreceptor drum 2 when |Vmax−Vo|>|Vth| before and after the photoreceptor drum reaches or has reached the charge control member 5, and the reverse charging (removal of electricity) is not carried out for the photoreceptor drum 2 when |Vmin−Vo|<|Vth|. Therefore, the opposite charge is prevented from being imparted to the residual toner on the photoreceptor drum 2 when the residual toner passes along the charge control member 5, and the charge property of the residual toner is stabilized. Moreover, the bias relation is established so that the regular charging is carried out for the photoreceptor drum 2 when |Vmax−Vo|>|Vth| before and after the photoreceptor drum reaches or has reached the charging member 3, and the reverse charging (removal of electricity) is not carried out for the photoreceptor drum 2 when |Vmin−Vo|<|Vth|. Therefore, the opposite charge is prevented from being imparted to the residual toner on the photoreceptor drum 2 when the residual toner passes along the charging member 3, and the charge property of the residual toner is stabilized. As a result, the toner adhesion to the charging member 3 is prevented, causing no defective charging. As a result, the image quality can be maintained satisfactory for a long term. Moreover, the developing unit 4 operates as a toner collecting section to carry out reliable toner collection. Accordingly, there is no need to separately provide a cleaner device in order to collect the toner that remains on the surface of the photoreceptor drum after transfer by the primary transfer unit 7. Even if such the cleaner device is eliminated as in this image forming apparatus, the image quality can be maintained satisfactory for a long term.

Furthermore, there is no need to provide cleaning means (mechanical or electrical technique) intended for cleaning the charging member 3. Moreover, this image forming apparatus, which regulates the peak-to-peak voltage value Vpp of the pulsating voltage Vsp, therefore does not require the complicated control of switching the discharge electric field or the like. Therefore, this image forming apparatus is constructed simple at low cost.

Figure 18:
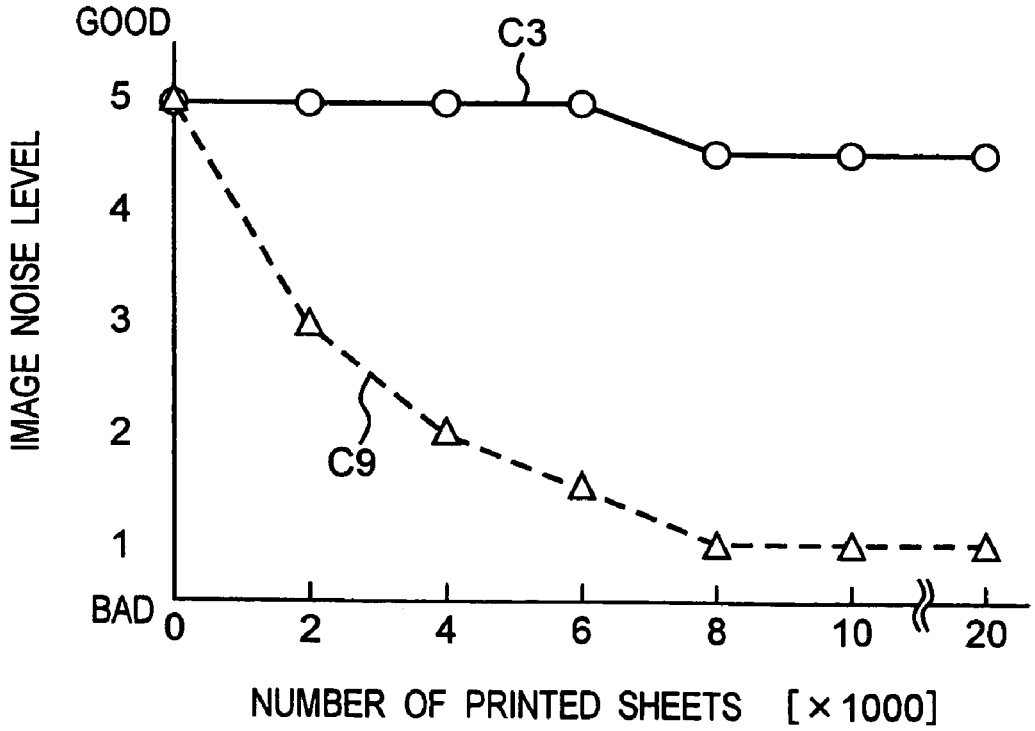
FIG. 18 is a graph showing a comparison between the fourth example of bias application shown in FIG. 16 and an example of bias application different from the fourth example of bias application with regard to test results of printing durability.

FIG. 18 shows a comparison between the case where the bias application conditions of the expressions (6) and (7) are used and the case where the bias application conditions of the expressions (6) and (7) are not satisfied with regard to test results of printing durability. In the graph, the horizontal axis represents the number of printed sheets (unit: 1000 sheets), and the vertical axis represents noise levels evaluating image noise in five steps. As a reference example in which the expressions (6) and (7) are not satisfied, the dashed line graph C9 in FIG. 18 indicates the result of carrying out the printing durability test on bias printing durability conditions such that:

$$|Vo(i)| \geqq |Vo(ii)|, \text{ and}$$

$$|Vmax-Vo| = |Vmin-Vo| = Vpp/2 \geqq |Vth|.$$

In this example of bias application (dashed line graph C9), the noise level three occurs when 2000 sheets have been printed due to the contamination (toner contamination) of the charging member (conductive roller) 3, and the image noise subsequently deteriorates to the level one. In contrast to this, when the bias application conditions of the expressions (6) and (7) are used, the level four or higher level is maintained up to 20000 sheets as indicated by the solid line graph C3.

Figure 17:
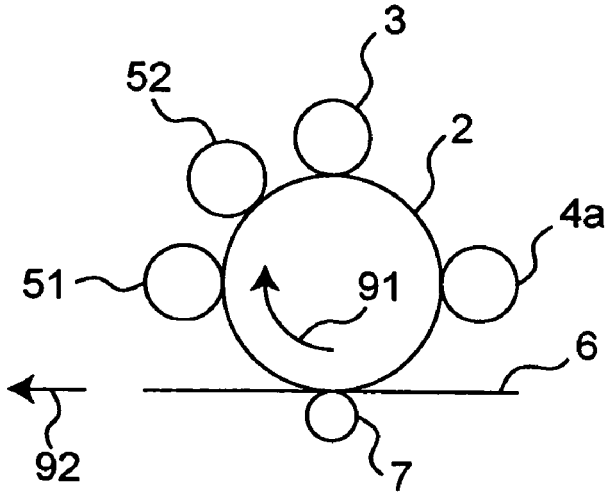
FIG. 17 is a view showing a modification example of the image forming unit in FIG. 1A.

FIG. 17 shows a modification example of the image forming unit in FIG. 1A. Although the image forming units 1Y, . . . , 1BK in FIG. 1A are each provided with only one charge control member 5, this image forming unit of FIG. 17 is provided with a plurality of (two in this example) charge control members 51 and 52 constructed of conductive rollers. These charge control members 51 and 52 are provided in positions located mutually on the upstream side and the downstream side in the movement direction 91 of the surface of the photoreceptor drum 2. Pulsating voltages Vspf1 and Vspf2, respectively, which are each obtained by superimposing a dc voltage component Vdc on a voltage component Vac that periodically changes, are mutually independently applied to these charge control members 51 and 52 from a bias power source 20 (see FIG. 1B).

In the construction provided with the plurality of charge control members 51 and 52 as described above, assuming that the surface voltages of the photoreceptor drum 2 before and after the photoreceptor drum reaches or has reached the charge control members 51 and 52 are Vo(α) and Vo(β), respectively, then it is preferable to satisfy the relation:

$$|Vo(\alpha)| < |Vo(\beta)| \tag{8}$$

and, assuming that the charging start voltage value of the photoreceptor drum 2 between the drum and the charge control members 51 and 52 is generically expressed by Vth, the surface voltage of the photoreceptor drum 2 is generically expressed by Vo, and the maximum value and the peak-to-peak voltage of the pulsating voltages Vspf1 and Vspf2 applied to the charge control members 51 and 52, respectively, are generically expressed by Vmax and Vpp, respectively, then it is preferable to satisfy the relation:

$$|Vmax-Vo| > |Vth| > Vpp \tag{9}$$

with regard to each of the charge control members 51 and 52.

If these bias application conditions (8) and (9) are satisfied, then the charge property (polarity) of the residual toner on the photoreceptor drum 2 after the residual toner has passed along the charge control members 51 and 52 is stabilized. Moreover, the regular charging is carried out for the photoreceptor drum when |Vmax−Vo|>|Vth| during the bias applying period of the charge control members 51 and 52, while the reverse charging is not carried out for the photoreceptor drum when $|Vmin-Vo|<|Vth|$. Therefore, the opposite charge is prevented from being imparted (injected) to the residual toner on the photoreceptor drum 2 when the residual toner passes along the charge control members 51 and 52, and the charge property of the residual toner is stabilized.

In the aforementioned embodiments, the charge control member 5 and the charging member 3 are each constructed of the conductive roller. However, the members are not limited to these but allowed to take the form of a pad or a sheet brought in contact or proximity with the surface of the photoreceptor drum 2. Furthermore, the charge control member 5 and the charging member 3 are only required to be able to control the surface voltage Vo of the photoreceptor drum 2 that serves as the object to be charged, and they are not always be a contact type. Moreover, the object to be charged and the electrostatic latent image carrier may be constructed of a belt or the like in place of the photoreceptor drum.

Although the voltage component Vac that changes periodically with the pulsating voltage Vsp has a rectangular waveform as an example, the waveform may be a pulse waveform of a sine wave, a triangular wave, a trapezoidal wave or the like.

The invention being thus described, it will be obvious that the invention may be varied in many ways. Such variations are not be regarded as a departure from the spirit and scope of the invention, and all such modifications as would be obvious to one skilled in the art are intended to be included within the scope of the following claims.

What is claimed is:

1. A charging device comprising:

a charging member opposed to an outer circumferential surface of a rotating object to be charged; and a voltage applying section for applying a pulsating voltage obtained by superimposing a voltage component of a direct current on a voltage component that periodically changes between the charging member and the object to be charged, wherein a relation of $$Vpp \leqq |Vth|$$

is satisfied, where

Vpp is a peak-to-peak voltage value of the pulsating voltage, and

Vth is a charging start voltage value of the object to be charged.

2. The charging device as claimed in claim 1, wherein a relation of $$|Vth| \leqq |Vdc|$$

is satisfied, where

Vdc is the voltage component of the direct current in the pulsating voltage.

3. The charging device as claimed in claim 1, wherein the charging member has a shape of a roller, a pad or a sheet.

4. A charging device comprising:

a charging member opposed to an outer circumferential surface of a rotating object to be charged; and a voltage applying section for applying a pulsating voltage obtained by superimposing a voltage component of a direct current on a voltage component that periodically changes between the charging member and the object to be charged, wherein a relation of $$|Vmax-Vo|>|Vth|>|Vmin-Vo|$$

is satisfied, where

Vth is a charging start voltage value of the object to be charged,

Vo is each voltage of the charged object surface located both upstream and downstream of the charging member in relation to a movement direction of the outer circumferential surface of the object to be charged, Vmax is a maximum value of the pulsating voltage, and Vmin is a minimum value of the pulsating voltage.

5. The charging device as claimed in claim 4, wherein a relation of $$|Vmin| \geqq |Vo|$$

is satisfied.

6. The charging device as claimed in claim 4, wherein the charging member has a shape of a roller, a pad or a sheet.

7. A charging device comprising:

a charging member opposed to an outer circumferential surface of a rotating object to be charged; and a charge control member opposed to the object to be charged in a position located upstream of the charging member in relation to a movement direction of the outer circumferential surface of the object to be charged; and a voltage applying section for applying voltages for controlling a surface voltage of the object to be charged, between the charge control member and the object to be charged and between the charging member and the object to be charged, respectively, wherein the voltages are applied so that a relation of $$|Vo(i)|<|Vo(ii)|<|Vo(iii)|$$

is satisfied, where

Vo(i) is a voltage of the charged object surface located upstream of the charge control member, Vo(ii) is a voltage of the charged object surface located downstream of the charge control member and upstream of the charging member, and Vo(iii) is a voltage of the charged object surface located downstream of the charging member.

8. The charging device as claimed in claim 7, wherein the voltage applying section applies a pulsating voltage obtained by superimposing a voltage component of a direct current on a voltage component that periodically changes between the charge control member and the object to be charged and/or between the charging member and the object to be charged, wherein a relation of $$|Vmax-Vo|>|Vth|>Vpp$$

is satisfied, where

Vth is a charging start voltage value of the object to be charged,

Vo is any one of the surface voltages Vo(i), Vo(ii) and Vo(iii) of the object to be charged, Vmax is a maximum value of the pulsating voltage, and Vpp is a peak-to-peak voltage value of the pulsating voltage.

9. The charging device as claimed in claim 7, wherein a plurality of the charge control members are provided in positions located upstream and downstream mutually in relation to the movement direction of the outer circumferential surface of the object to be charged, all or part of the plurality of charge control members is selectively applied by the voltage applying section with a pulsating voltage obtained by superimposing a voltage component of a direct current on a voltage component that periodically changes, wherein a relation of $$|Vo(\alpha)|<|Vo(\beta)|$$

is satisfied, where

Vo(α) is a voltage of the charged object surface located upstream of one of the charge control members to which the pulsating voltage is applied, Vo(β) is a voltage of the charged object surface located downstream of the charge control member to which the pulsating voltage is applied and upstream of another adjacent charge control member, and wherein a relation of $$|V\max-Vo|>|Vth|>Vpp$$

is satisfied with regard to the charge control member to which the pulsating voltage is applied, where Vth is a charging start voltage value of the object to be charged, Vo is any one of the surface voltages Vo(α) and Vo(β) of the object to be charged, Vmax is a maximum value of the pulsating voltage, and Vpp is a peak-to-peak voltage value of the pulsating voltage.

10. An image forming apparatus of an electrophotographic system, comprising:

a charging device for uniformly charging an outer circumferential surface of an electrostatic latent image carrier that serves as a rotating object to be charged, the charging device comprising:

a charging member opposed to the outer circumferential surface of the electrostatic latent image carrier; and a voltage applying section for applying a pulsating voltage obtained by superimposing a voltage component of a direct current on a voltage component that periodically changes between the charging member and the electrostatic latent image carrier, wherein a relation of $$Vpp\leqq|Vth|$$

is satisfied, where

Vpp is a peak-to-peak voltage value of the pulsating voltage, and

Vth is a charging start voltage value of the electrostatic latent image carrier, an exposure device for forming a latent image by exposing the outer circumferential surface of the electrostatic latent image carrier;

a developing device for developing the latent image by making toner adhere to the latent image; and a transfer device for transferring the toner onto an object to receive transfer.

11. The image forming apparatus as claimed in claim 10, wherein a relation of $$|Vth|\leqq|Vdc|$$

is satisfied, where

Vdc is the voltage component of the direct current in the pulsating voltage.

12. The image forming apparatus as claimed in claim 10, wherein the charging member has a shape of a roller, a pad or a sheet.

13. The image forming apparatus as claimed in claim 10, wherein the developing device has a toner collecting section for collecting the toner that remains on the surface of the electrostatic latent image carrier after transfer by the transfer device.

14. An image forming apparatus of an electrophotographic system comprising:

a charging device for uniformly charging an outer circumferential surface of an electrostatic latent image carrier that serves as a rotating object to be charged, the charging device comprising:

a charging member opposed to the outer circumferential surface of the electrostatic latent image carrier; and a voltage applying section for applying a pulsating voltage obtained by superimposing a voltage component of a direct current on a voltage component that periodically changes between the charging member and the electrostatic latent image carrier, wherein a relation of $$|V\max-Vo|>|Vth|>|V\min-Vo|$$

is satisfied, where

Vth is a charging start voltage value of the electrostatic latent image carrier, Vo is each voltage of the electrostatic latent image carrier surface located upstream and downstream of the charging member in relation to a movement direction of the outer circumferential surface of the electrostatic latent image carrier, Vmax is a maximum value of the pulsating voltage, and Vmin is a minimum value of the pulsating voltage, an exposure device for forming a latent image by exposing the outer circumferential surface of the electrostatic latent image carrier;

a developing device for developing the latent image by making toner adhere to the latent image; and a transfer device for transferring the toner onto an object to receive transfer.

15. The image forming apparatus as claimed in claim 14, wherein a relation of $$|Vmin|\geqq|Vo|$$

is satisfied.

16. The image forming apparatus as claimed in claim 14, wherein the charging member has a shape of a roller, a pad or a sheet.

17. The image forming apparatus as claimed in claim 14, wherein the developing device has a toner collecting section for collecting the toner that remains on the surface of the electrostatic latent image carrier after transfer by the transfer device.

18. An image forming apparatus of an electrophotographic system comprising:

a charging device for uniformly charging an outer circumferential surface of an electrostatic latent image carrier that serves as a rotating object to be charged, the charging device comprising:

a charging member opposed to the outer circumferential surface of the electrostatic latent image carrier;

a charge control member opposed to the electrostatic latent image carrier in a position located upstream of the charging member in relation to a movement direction of the outer circumferential surface of the electrostatic latent image carrier; and a voltage applying section for applying voltages for controlling a surface voltage of the electrostatic latent image carrier between the charge control member and the electrostatic latent image carrier and between the charging member and the electrostatic latent image carrier, respectively, wherein the voltages are applied so that a relation of $$|Vo(i)|<|Vo(ii)|<|Vo(iii)|$$

is satisfied, where

Vo(i) is a voltage of the electrostatic latent image carrier surface located upstream of the charge control member, Vo(ii) is a voltage of the electrostatic latent image carrier surface located downstream of the charge control member and upstream of the charging member, and Vo(iii) is a voltage of the electrostatic latent image carrier surface located downstream of the charging member, an exposure device for forming a latent image by exposing the outer circumferential surface of the electrostatic latent image carrier;

a developing device for developing the latent image by making toner adhere to the latent image; and a transfer device for transferring the toner onto an object to receive transfer.

19. The image forming apparatus as claimed in claim 18, wherein the voltage applying section applies a pulsating voltage obtained by superimposing a voltage component of a direct current on a voltage component that periodically changes between the charge control member and the electrostatic latent image carrier and/or between the charging member and the electrostatic latent image carrier, wherein a relation of $$|V\max-Vo|>|Vth|>Vpp$$

is satisfied, where

Vth is a charging start voltage value of the electrostatic latent image carrier, Vo is any one of the surface voltages Vo(i), Vo(ii) and Vo(iii) of the electrostatic latent image carrier, Vmax is a maximum value of the pulsating voltage, and Vpp is a peak-to-peak voltage value of the pulsating voltage.

20. The image forming apparatus as claimed in claim 18, wherein a plurality of the charge control members are provided in positions located upstream and downstream mutually in relation to the movement direction of the outer circumferential surface of the electrostatic latent image carrier, all or part of the plurality of charge control members is selectively applied by the voltage applying section with a pulsating voltage obtained by superimposing a voltage component of a direct current on a voltage component that periodically changes, wherein a relation of $$|Vo(\alpha)|<|Vo(\beta)|$$

is satisfied, where

Vo(α) is a voltage of the electrostatic latent image carrier surface located upstream of one of the charge control members to which the pulsating voltage is applied, Vo(β) is a voltage of the electrostatic latent image carrier surface located downstream of the charge control member to which the pulsating voltage is applied and upstream of another adjacent charge control member, and wherein a relation of $$|V\max-Vo|>|Vth|>Vpp$$

is satisfied with regard to the charge control member to which the pulsating voltage is applied, where Vth is a charging start voltage value of the electrostatic latent image carrier, Vo is any one of the surface voltages Vo(α) and Vo(β) of the electrostatic latent image carrier, Vmax is a maximum value of the pulsating voltage, and Vpp is a peak-to-peak voltage value of the pulsating voltage.

21. The image forming apparatus as claimed in claim 18, wherein the developing device has a toner collecting section for collecting the toner that remains on the surface of the electrostatic latent image carrier after transfer by the transfer device.

* * * * *